US008672153B2

(12) United States Patent
Priebe et al.

(10) Patent No.: US 8,672,153 B2
(45) **Date of Patent: *Mar. 18, 2014**

(54) PUSH TAB VIAL ASSEMBLY AND METHODS

(75) Inventors: Robert N. Priebe, Bloomington, MN (US); Terrance O. Noble, Burnsville, MN (US)

(73) Assignee: Apothecary Products, Inc., Burnsville, MN (US)

( * ) Notice: Subject to any disclaimer, the term of this patent is extended or adjusted under 35 U.S.C. 154(b) by 104 days.

This patent is subject to a terminal disclaimer.

(21) Appl. No.: 13/045,161

(22) Filed: Mar. 10, 2011

(65) Prior Publication Data

US 2011/0180540 A1 Jul. 28, 2011

Related U.S. Application Data

(63) Continuation of application No. 12/133,778, filed on Jun. 5, 2008, now Pat. No. 7,942,280.

(51) Int. Cl.
*B65D 55/02* (2006.01)
*B65D 41/04* (2006.01)

(52) U.S. Cl.
USPC ..... 215/221; 215/330

(58) Field of Classification Search
USPC ..... 215/217, 221, 330, 216, 211, 213, 241, 215/301; 220/254.8
See application file for complete search history.

(56) References Cited

U.S. PATENT DOCUMENTS 3,884,379 A 5/1975 Landen
4,103,797 A 8/1978 Morris
4,852,751 A 8/1989 Halfacre
5,207,341 A 5/1993 Yeager
5,711,442 A 1/1998 Kusz
5,740,933 A 4/1998 Conti et al.
(Continued)

OTHER PUBLICATIONS

Photographs of commercial products, identified in Exhibits A, B, C, and D; each of the commercial products being in existence before Jun. 5, 2008.

*Primary Examiner* — Mickey Yu
*Assistant Examiner* — Niki Eloshway
(74) *Attorney, Agent, or Firm* — Merchant & Gould P.C.

(57) ABSTRACT

A push tab container assembly includes a container and a lid configured to mate with the container in an unlocked state and in a locked state. The container includes a push tab assembly having a locking member defining a ramped surface and ending at a locking edge. The locking edge is vertically oriented with respect to the ramped surface and is tapered as it extends radially inwardly. The container has exactly one external container thread positioned on an external surface and at least one internal thread positioned on an internal surface. The lid has at least one locking lug positioned on an internal surface of a second skirt. The locking lug has a lug edge that tapers as it extends radially inwardly. When the lid is operably oriented relative to the container in the unlocked state, the external lid thread is mated with the internal container thread. When the lid is operably oriented relative to the container in the locked state, the internal lid thread is mated with the exactly one external container thread, while the locking edge of the locking member is engaged against the lug edge of the locking lug. The push tab assembly is actuatable to release the locking edge of the locking member from the lug edge of the locking lug to permit disengagement of the lid from the container.

5 Claims, 17 Drawing Sheets

(56) References Cited

U.S. PATENT DOCUMENTS

| | | | | |
|---|---|---|---|---|
| 5,836,466 | A | 11/1998 | Briere et al. | |
| 5,899,348 | A | 5/1999 | Konefal et al. | |
| 6,039,195 | A | 3/2000 | Konefal et al. | |
| 6,076,689 | A | 6/2000 | Vassallo | |
| 6,327,770 | B1 | 12/2001 | Konefal et al. | |
| 6,508,373 | B1 | 1/2003 | Robinson | |
| 7,823,736 | B1 | 11/2010 | Pugne et al. | |
| 7,942,280 | B2 * | 5/2011 | Priebe et al. | 215/217 |
| 2002/0166834 | A1 | 11/2002 | Branson et al. | |
| 2006/0070970 | A1 | 4/2006 | Shingle | |
| 2007/0062901 | A1 | 3/2007 | Konefal | |

* cited by examiner

PUSH TAB VIAL ASSEMBLY AND METHODS

CROSS REFERENCE TO RELATED APPLICATION

This application is a continuation of application Ser. No. 12/133,778, filed Jun. 5, 2008, which application is incorporated herein by reference in its entirety.

TECHNICAL FIELD

This disclosure relates generally to pill containers, and more particularly, this disclosure relates to lid and pill container combinations.

BACKGROUND

Containers with child lock capabilities have been developed. One such container is a cylindrical pill vial that can be used with a child resistant lid or closure member. Improvements in these types of containers are desirable.

SUMMARY

In one aspect, a push tab container assembly includes a container and a lid configured to mate with the container in an unlocked state and in a locked state. The container includes a push tab assembly having a locking member defining a ramped surface and ending at a locking edge. The locking edge is vertically oriented with respect to the ramped surface and is tapered as it extends radially inwardly. The container has exactly one external container thread positioned on an external surface and at least one internal thread positioned on an internal surface. The lid has first and second peripheral skirts. The first skirt has at least external lid thread positioned on an external surface of the first skirt. The second skirt has at least internal lid thread and at least one locking lug positioned on the internal surface of the second skirt. The locking lug includes a locking lug edge projecting radially from the second skirt. The lug edge is tapered as it extends radially inwardly. When the lid is operably oriented relative to the container in the unlocked state, the external lid thread is mated with the internal container thread. When the lid is operably oriented relative to the container in the locked state, the internal lid thread is mated with the exactly one external container thread, while the locking edge of the locking member is engaged against the lug edge of the locking lug. The push tab assembly is actuatable to release the locking edge of the locking member from the lug edge of the locking lug to permit disengagement of the lid from the container.

In other aspects, a push tab container is provided and a lid is provided.

In another aspect, a method of mounting a lid to a vial is provided. The method includes selectively operably locking the lid onto the vial by engaging an internal thread on the lid with exactly one external thread on the vial and engaging a tapered locking edge of a locking member extending from a push tab assembly of the vial against a tapered lug edge of a locking lug projecting radially inwardly from an internal surface of the lid. The method further includes selectively releasing the lid and vial from being locked by exerting a push force on the push tab assembly to release engagement between the locking edge and the lug edge, while exerting a relative rotation of the lid and vial to remove the lid from the vial. The method further includes turning the lid over to selectively engage an external thread on the lid with an internal thread on the vial to threadably mate in an unlocked state.

DETAILED DESCRIPTION

In general, this disclosure describes storage containers that include locking features that control access to the internal volume of the container. One type of container that is particularly relevant to the principles disclosed herein is a pill storage container or vial. The container, lid, or combination of container and lid may include features that provide secure mounting of the lid to the container and locking in a manner to prevent children being able to gain access to the interior of the container. In preferred embodiments, the container further includes features that will allow the container and lid to be used together in a manner which will close the container in an unlocked condition.

A. Example Container

Figure 1:
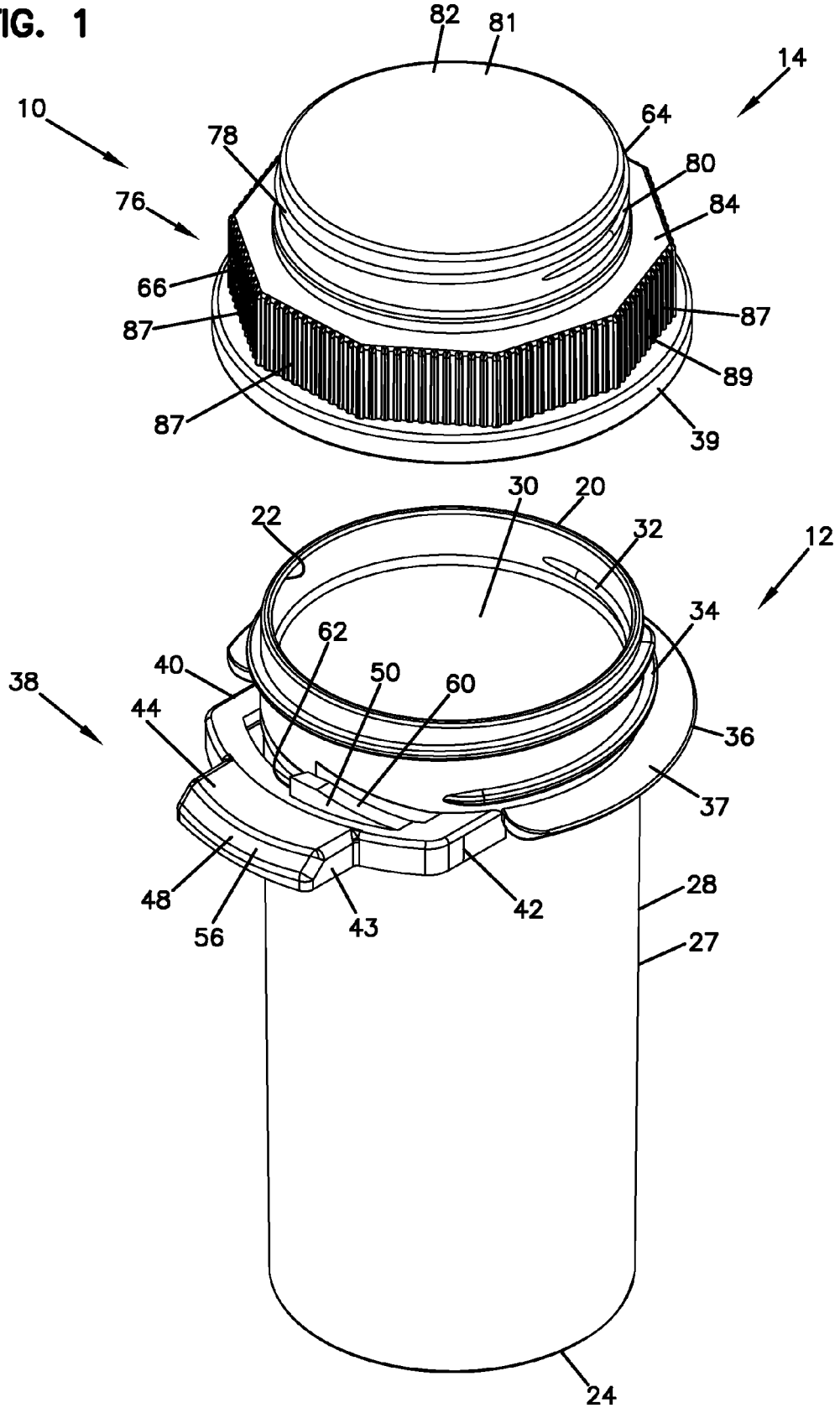
FIG. 1 is a perspective view of a first embodiment of a container and lid, constructed in accordance with principles of this disclosure.
Figure 2:
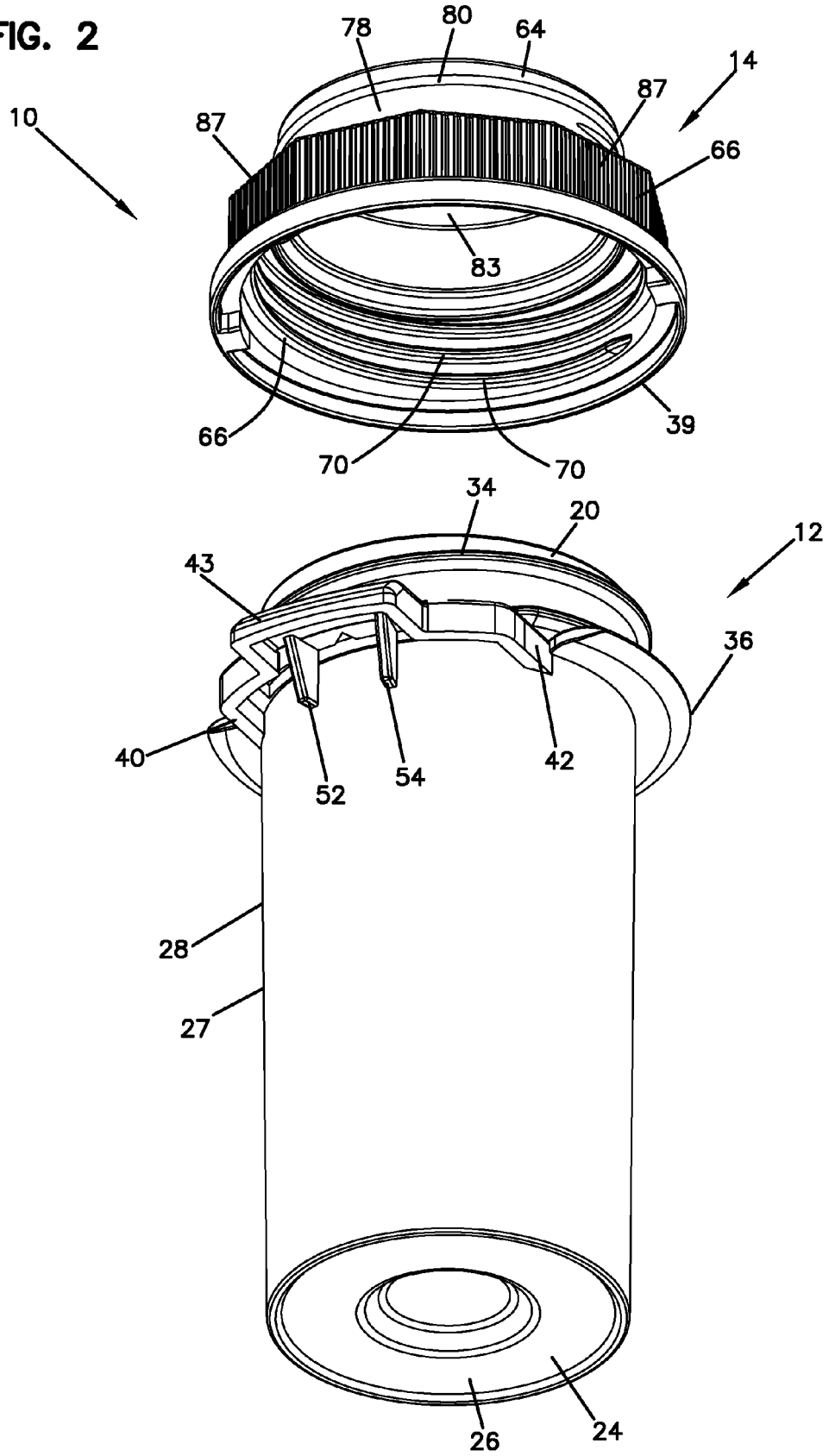
FIG. 2 is another perspective view of the assembly depicted in FIG. 1.
Figure 3:
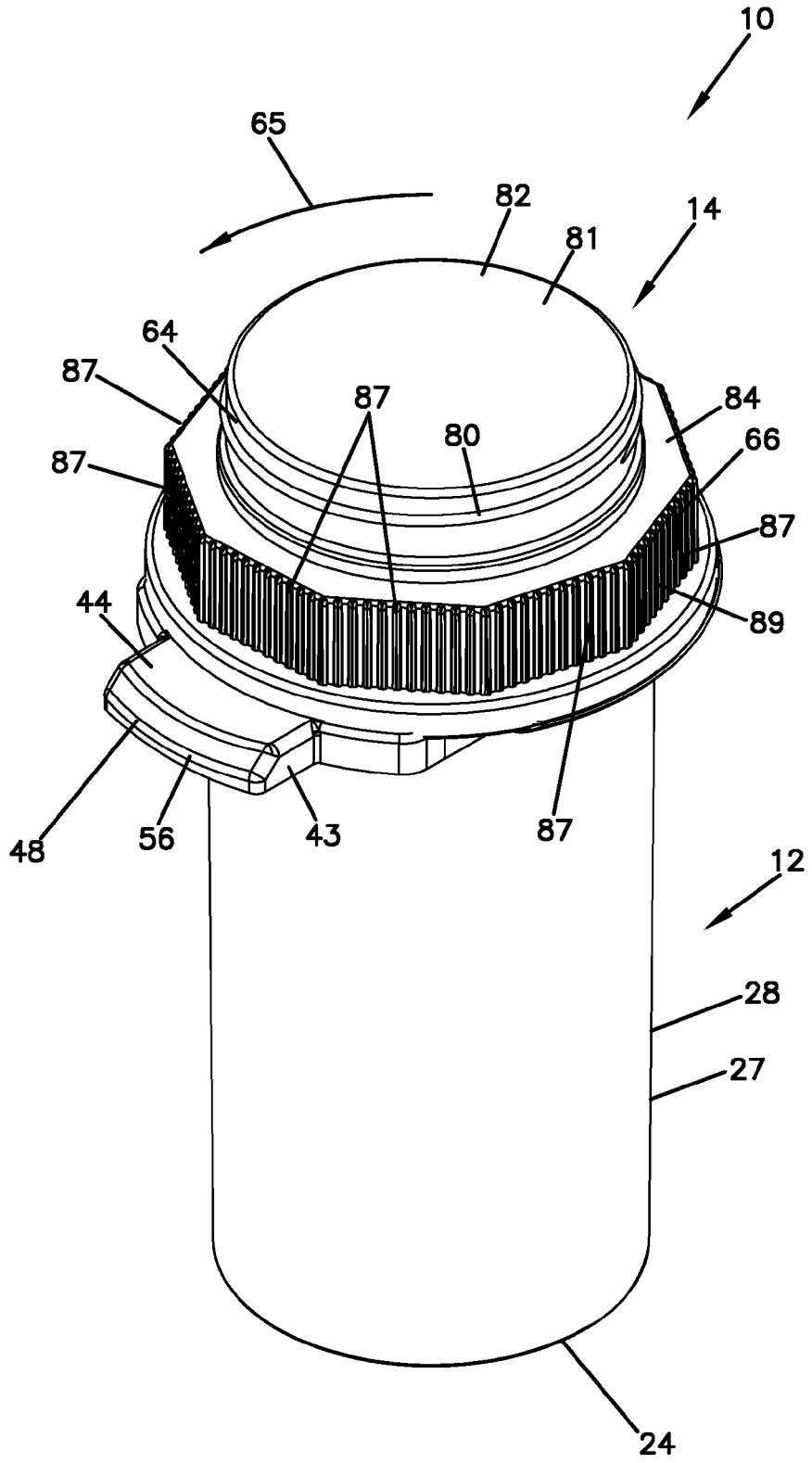
FIG. 3 is a perspective view of the assembly of FIGS. 1 and 2, and shown assembled together in a locked condition.
Figure 4:
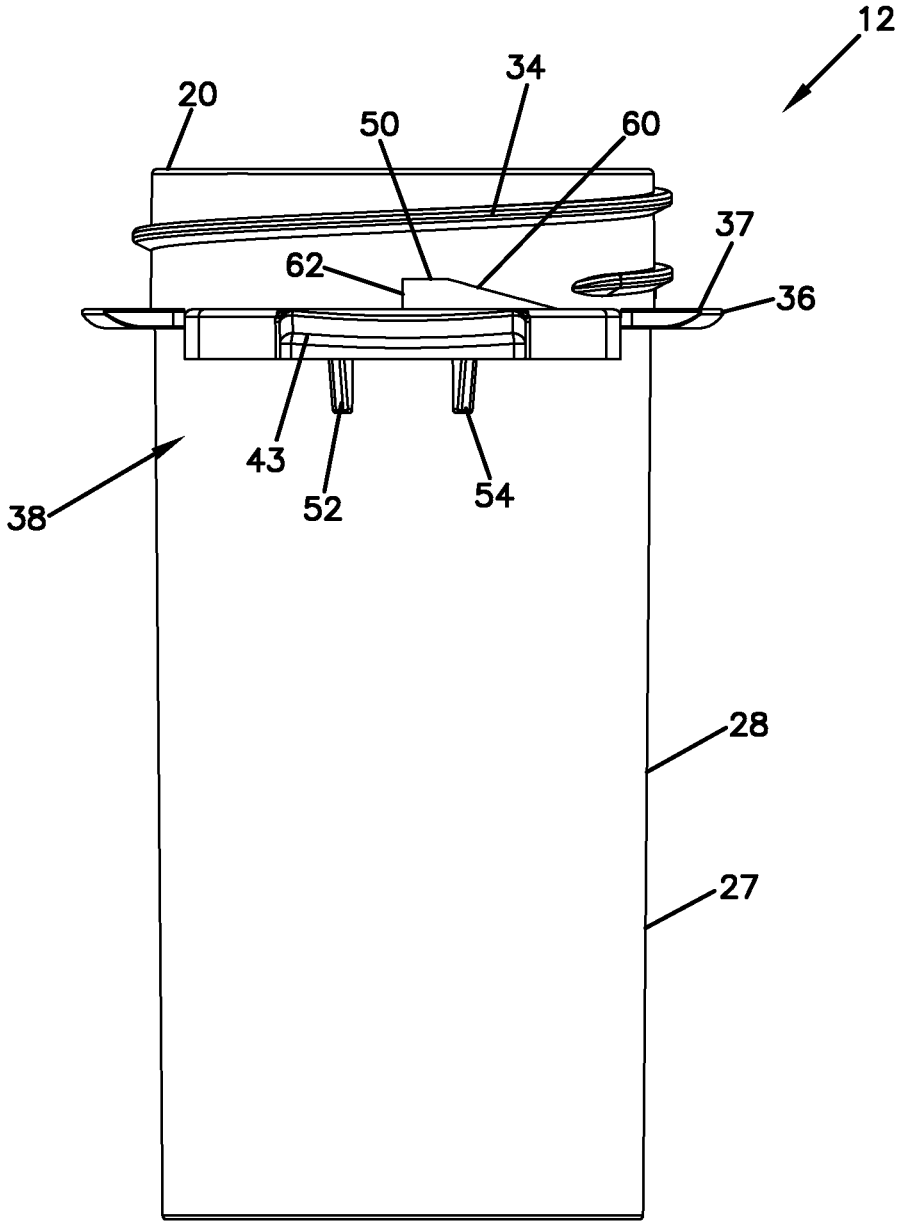
FIG. 4 is a front elevational view of the container of FIGS. 1-3.
Figure 5:
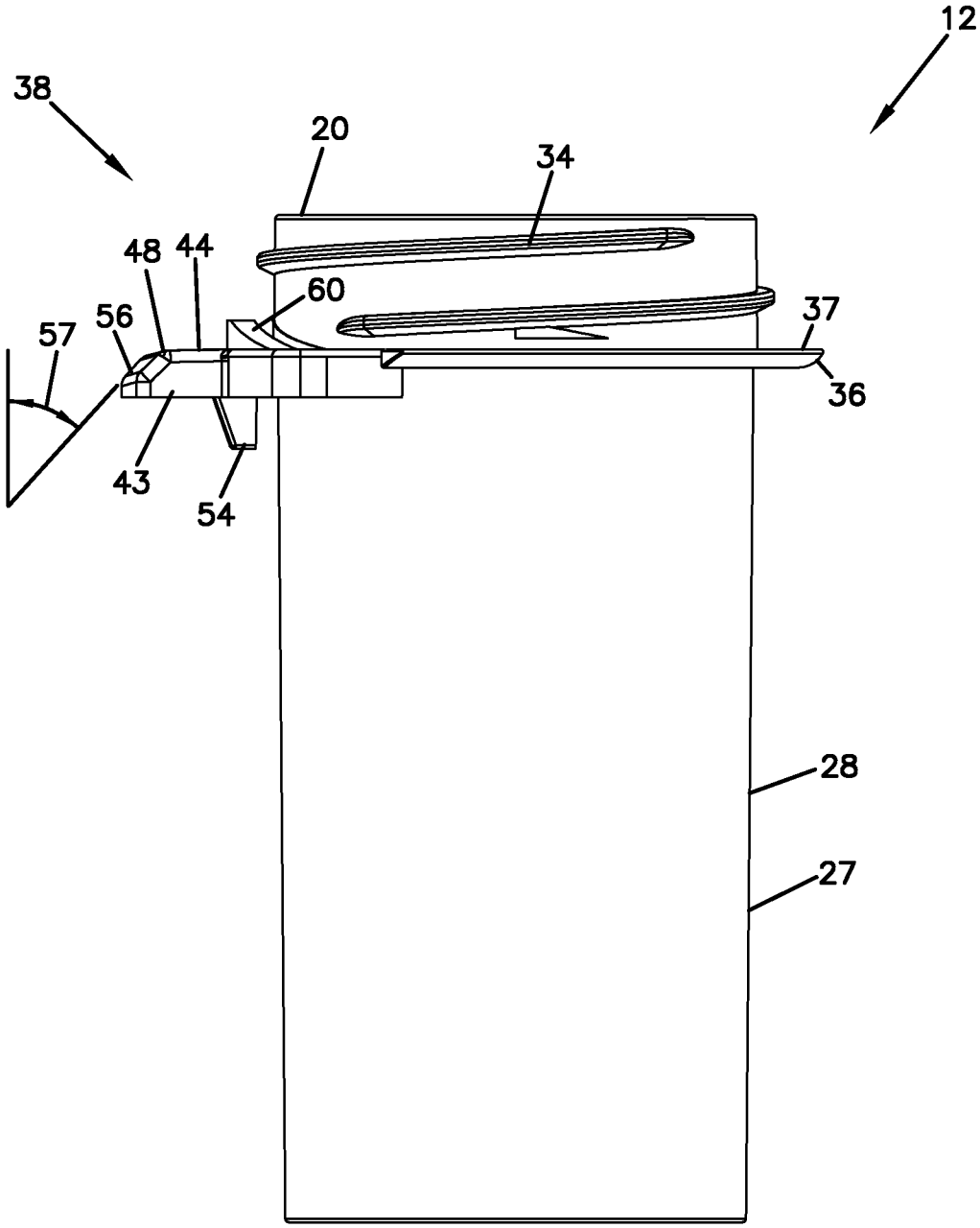
FIG. 5 is a right side elevational view of the container of FIG. 4.
Figure 6:
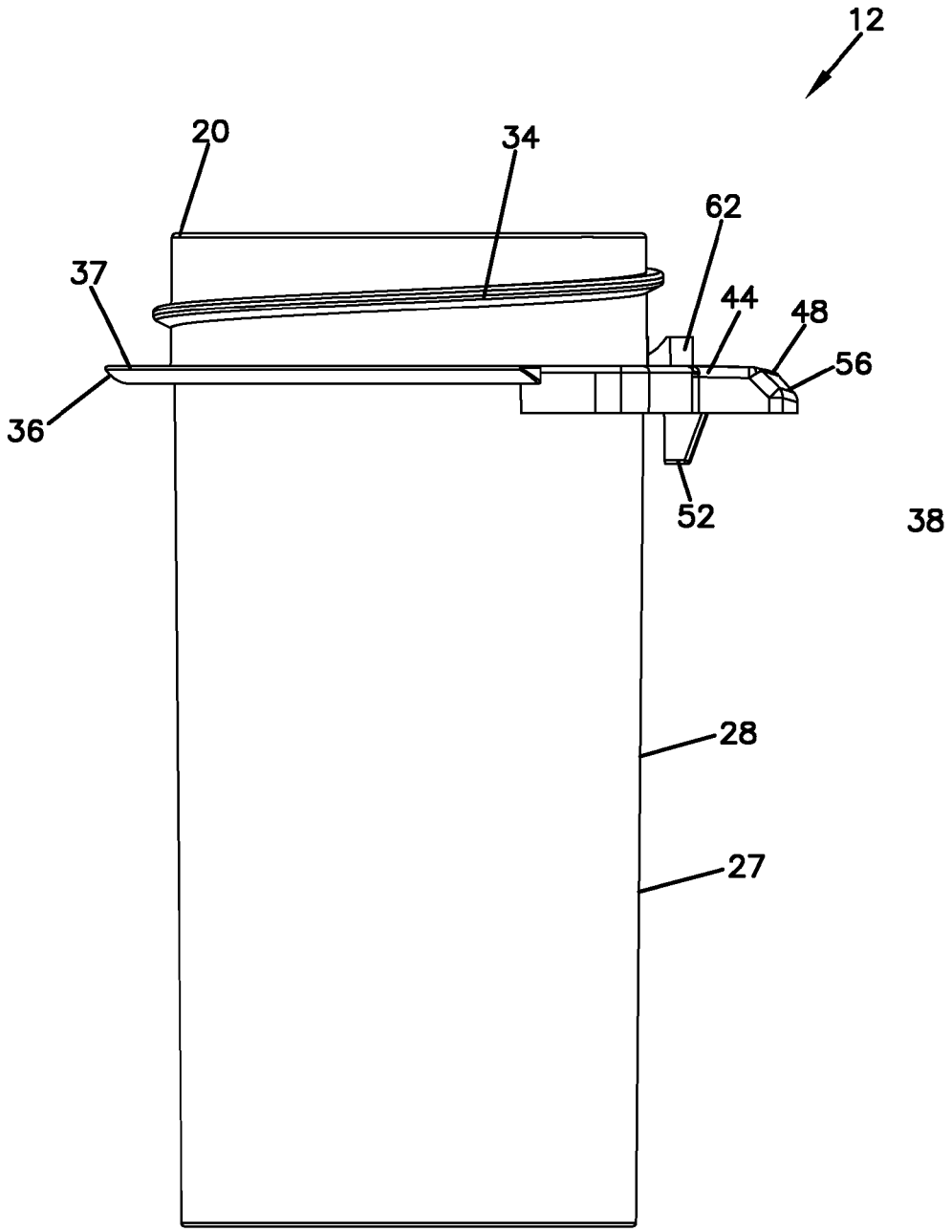
FIG. 6 is a left side elevational view of the container depicted in FIGS. 4 and 5.

A push tab container assembly 10 is depicted in FIG. 1. The assembly 10 includes a container 12 and a selectively removable lid 14. FIG. 1 depicts the assembly 10 before the lid 14 is operably mounted in covering relation to the container 12. FIGS. 20-24 depict the assembly 10 when the lid 14 is mounted in a "locked condition" on the container 12. The "locked condition" is further explained below.

Container 12 (also referred to herein as a vial 12 or pill vial 12) is described with respect to the embodiment illustrated in FIGS. 1-9 and 20-24. Container 12 includes an upper end 20 defining a mouth or opening 22, a closed bottom end 24 defining a bottom surface 26, and a surrounding wall 27 defining the opening 22 and extending between the opening 22 and the bottom end 24. The surrounding wall 27 defines an exterior surface 28 and an interior surface 30.

Adjacent to the opening 22 and along the exterior surface 28 of the wall 27 is a container thread 34. In the embodiment shown, there is exactly one external thread 34, which means there is no more than one external container thread 34. Having exactly one external container thread 34 provides advantages in manufacturing techniques in that the molding process is simplified. The external container thread 34 is for threadably mating with an associated threaded connection on a lid 14, described further below.

Along the interior surface 34 of the wall 27 and adjacent to the opening 22 is at least one internal thread 32. While there is at least one internal container thread 32 for matably connecting with an associated threaded connection on a portion of lid 14, described below, in the embodiment shown, there is exactly one internal container thread 32. Again, this is advantageous in terms of simplifying the manufacturing technique. Even though only a single internal container thread 32 is depicted, in other embodiments, there may be more than one internal container thread 32.

In the embodiment shown, the container 12 further includes a flange 36 extending radially from the wall 27 between the external threads 34 and the bottom end 24. The flange 36 extends at least around a portion of the outer circumference of the wall 27. The radial flange 36 includes engagement surface 37 for engaging with and, in some embodiments, forming a seal with a bottom rim 39 on lid 14. The flange 36 is also helpful structure for grasping in order to handle and manipulate the container 12. The flange 36 also acts as a position stop to limit the amount of rotation of lid 14 mounted on the container 12.

In the embodiment shown, the container 12 also preferably includes a push tab assembly 38. In the embodiment shown, the push tab assembly 38 is mounted on the external surface 28 of the wall 27. In general, the push tab assembly 38 is positioned adjacent to the opening 22 and along the same location along the wall 27 as the flange 36. In general, the push tab assembly 38 functions to release the lid 14 and container 12 from being in a locked state. The locked state, in this embodiment, means having the lid 14 and container 12 in a "child resistant" state. By the term "child resistant", it is meant structural features that require coordination and/or strength that is atypical of what a child under a certain age, for example, under a certain age (for example, less than 10 years of age) can apply in order to release a locking engagement between the container 12 and lid 14.

In the embodiment shown, the push tab assembly 38 includes first and second connecting arms 40, 42, an engagement member 43 having a top surface 44, a bottom surface 46 (FIG. 9), a contact edge 48, a locking member 50, and first and second stop members 52, 54. The push tab assembly 38 is mounted to the exterior surface 28 of the wall 27 by way of the connecting arms 40, 42. The connecting arms 40, 42 typically are constructed as resilient or elastic members. The connecting arms 40, 42 return to their original shape and orientation after a push force has been released from the push tab assembly 38.

In preferred embodiments, the top surface 44 of the engagement member 43 is relatively smooth for providing a comfortable engagement with a user's thumb or other fingers. In the embodiment shown, the top surface 44 is generally flat, until reaching the contact edge 48, which has a bevel 56. Text that is embossed, stamped, printed, or otherwise mounted to the bottom surface 46 is preferably viewable through the top surface 44. In one example, the term "press" positioned on the bottom surface, is viewable through the top surface 44, thus providing instructions for the user to press on the top surface 44 at that location to actuate the push tab assembly 38.

As mentioned above, the contact edge 48 includes a bevel 56. The bevel 56 can improve comfort for the user when he applies a force to the top surface 44 and along the contact edge 48. The bevel 56 is in a direction downwardly and outwardly from a direction of the open end 22 of the container 12. Preferably, the bevel 56 is at an angle 57 (FIG. 5) of 40-50 degrees. Preferably, the contact edge 48, including the bevel 56 has a smoothness with a finish of SPI A-2. The combination of bevel 56 and the surface smoothness results in a more comfortable operation by the user, avoiding blistering of fingers, if for example, no bevel and a rougher finish is used.

The locking member 50 extends from the top surface 44 toward the upper end 20. In this embodiment, the locking member 50 has a cam or a ramped surface 60 and a locking edge 62. When mounting lid 14 to the container 12, a locking lug 72 (described further below) of the lid 14 engages and slides along the ramped surface 60 and then drops behind the locking edge 62. Engagement between the locking edge 62 and the locking lug 72 of the lid 14 helps to prevent the lid 14 from rotating counterclockwise for removal from the container 12.

Figure 7:
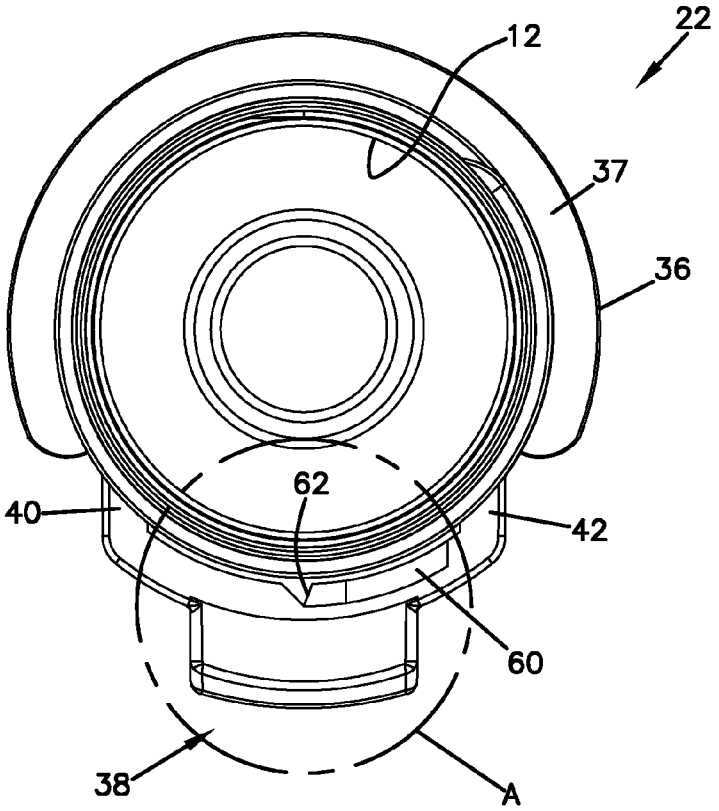
FIG. 7 is a top plan view of the container depicted in FIGS. 4-6.
Figure 8:
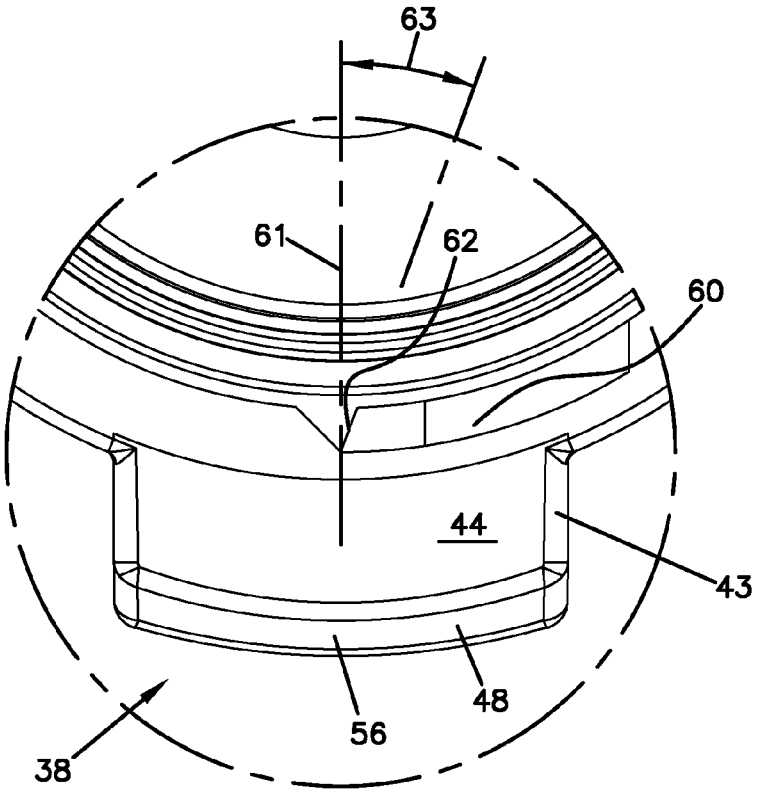
FIG. 8 is an enlarged view of Section A of FIG. 7.
Figure 9:
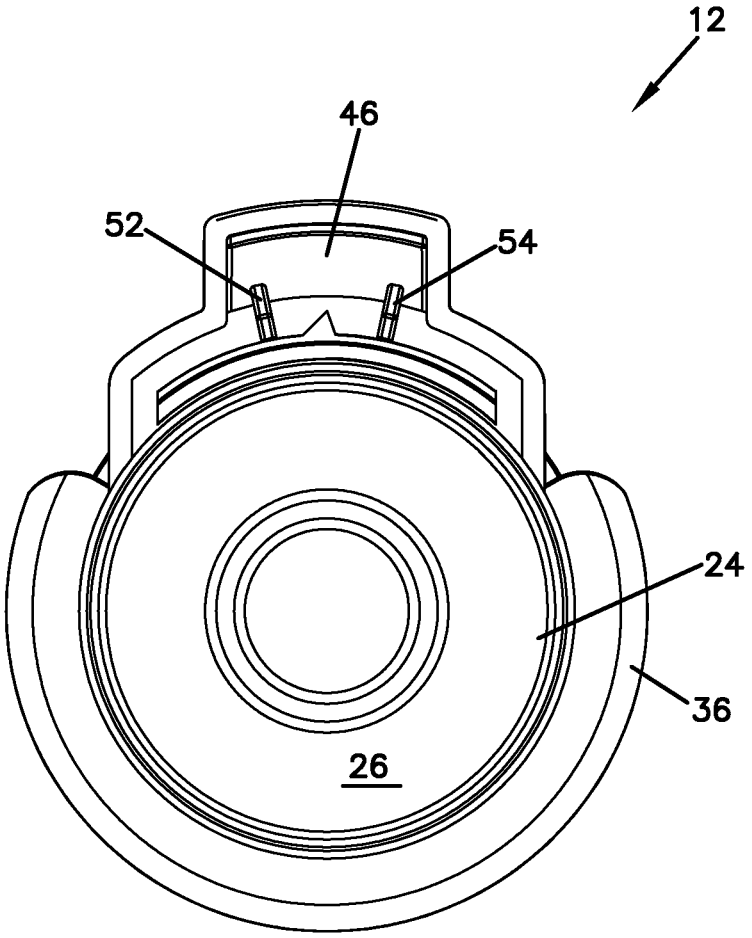
FIG. 9 is a bottom plan view of the container of FIGS. 4-8.

Attention is next directed to FIGS. 4, 6, 7, and 8. Various views of the locking edge 62 can be seen. Locking edge 62 cooperates with lug edge 73 (described below) to result in a lock that is more certain that prior art locks in that it is harder to defeat. It provides enhanced ability to resist opening. The locking edge 62, in this embodiment, is vertically oriented with respect to the ramped surface 60. The locking edge 62 is tapered as can be seen especially in FIG. 8 with respect to an axis line 61 that passes through a center point of the opening 22. The angle of taper is shown at reference numeral 63 in FIG. 8. Preferably, the locking edge 62 will be tapered at an angle of between 10-30 degrees. In the embodiment shown, the angle 63 is about 15-25 degrees. As can be seen in FIGS. 7 and 8, the locking edge 62 is tapered as it extends radially inwardly in a direction toward the opening 22.

The first and second stop members 52, 54 extend from the bottom surface 46. The stop members 52, 54 at as position stops for the push tab assembly 48 when a force is applied to the top surface 44 to rotate the lid 14 in a direction of release rotation in order to remove the lid 14 from the container 12. The release rotation direction is depicted by arrow 65 in FIG. 3. As viewed in FIG. 3, the arrow direction 65 is a counterclockwise rotation. The stop members 52, 54 extend vertically downwardly from the engagement member 43, and upon pushing the engagement member 43, the arms 40, 42 will flex and move the first and second stop member 52, 54 into a position that can engage the exterior surface 28 of the surrounding wall 27. Once the stop members 52, 54 engage the wall 27, the engagement member 43 can no longer be pushed downwardly which protects the arms 40, 42 from over extension and damage. The length of the stop members 52, 54 are sufficiently short to allow for enough deflection of the engagement 43 to allow for release between the locking edge 62 and the lug edge 73, while being sufficiently long to prevent over extension of the engagement member 43 possibly creating damage of the first and second arms 40, 42.

The container 12 has a predetermined volume, preferably sized to accommodate pills, eye droppers, ointments, or other types of prescribed medication. The length of the container 12 between the upper and bottom ends 20, 24, as well as the diameter of the surrounding wall 27 will influence the volume of the container 12. Changing the diameter may require modifications to the push tab assembly 38 to provide proper functionality. For example, the size, shape, and position of the stop members 52, 54 may need to be varied depending on an increase or decrease in the diameter of the container 12. In another example, the size and shape of the first and second connecting arms 40, 42 including, for example, the length, thickness, and shape of the connecting arms 40, 42 can be varied to address any change in diameter of the container 12. In one example, the push tab assembly can be used in connection with a rectangular-shaped container having an otherwise planar surface upon which the push tab assembly 38 is mounted.

B. Example Lid

One embodiment of a usable lid 14 is depicted in FIGS. 10-19, as well as in combination with the container 12 in other FIGS. The lid 14 is configured to mate with the container 12 in an unlocked state and in a locked state. This is described further below.

In the embodiment shown, the lid 14 includes a first peripheral skirt 64. The first skirt 64 defines an outer surface 78 and at least external lid thread 80 positioned on the outer surface 78. In the particular embodiment shown, there is exactly one external lid thread 80 depicted, which is advantageous in terms of simplifying manufacturing techniques. In other embodiments, however, there can be more than one external lid thread 80. In this embodiment, the external lid thread 80 is only a single thread, which matches the single internal container thread 32 on the container 12.

Figure 10:
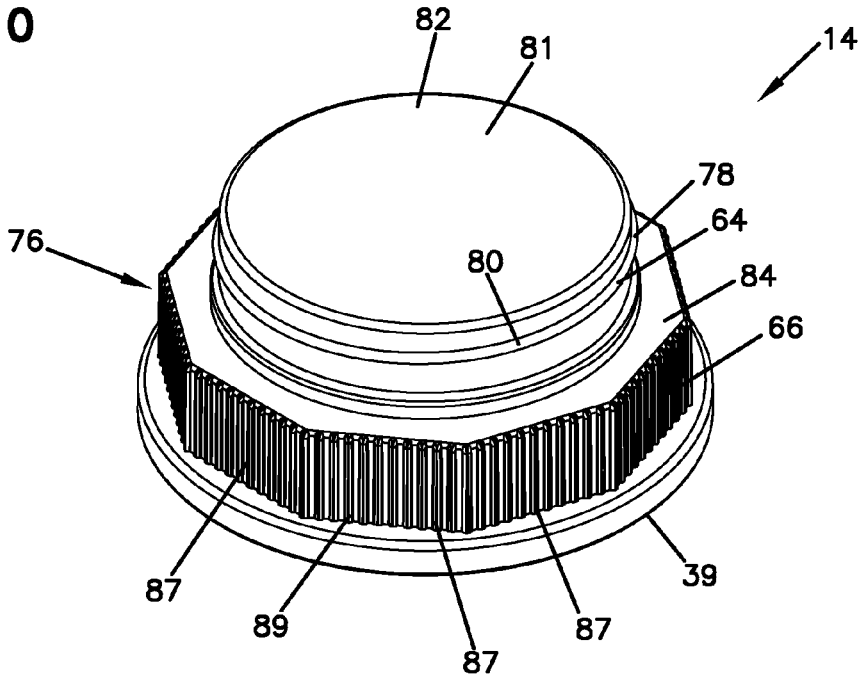
FIG. 10 is a perspective view of the lid depicted in FIGS. 1-3.
Figure 11:
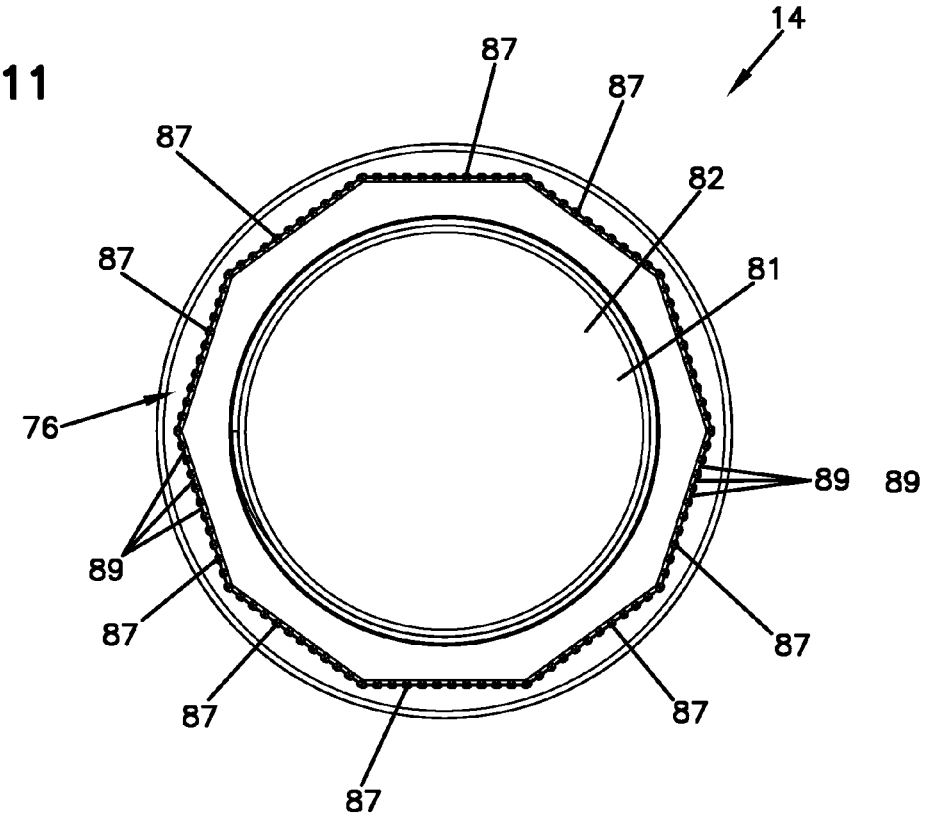
FIG. 11 is a top plan view of the lid of FIG. 10.
Figure 12:
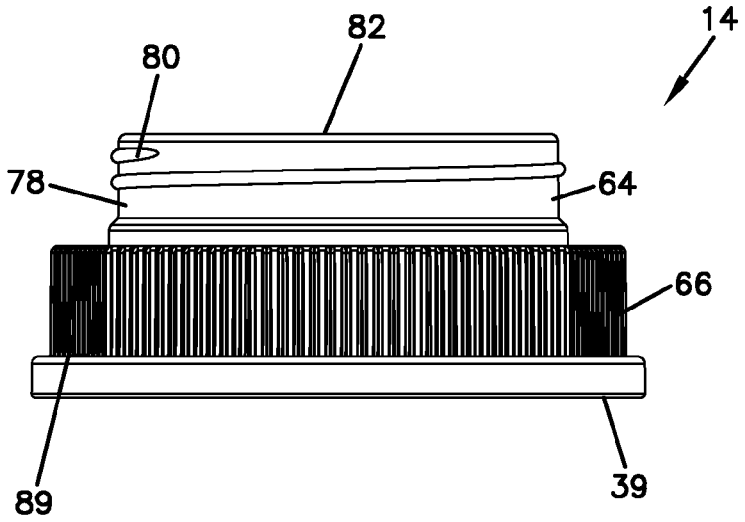
FIG. 12 is a front side elevational view of the lid of FIG. 10.
Figure 13:
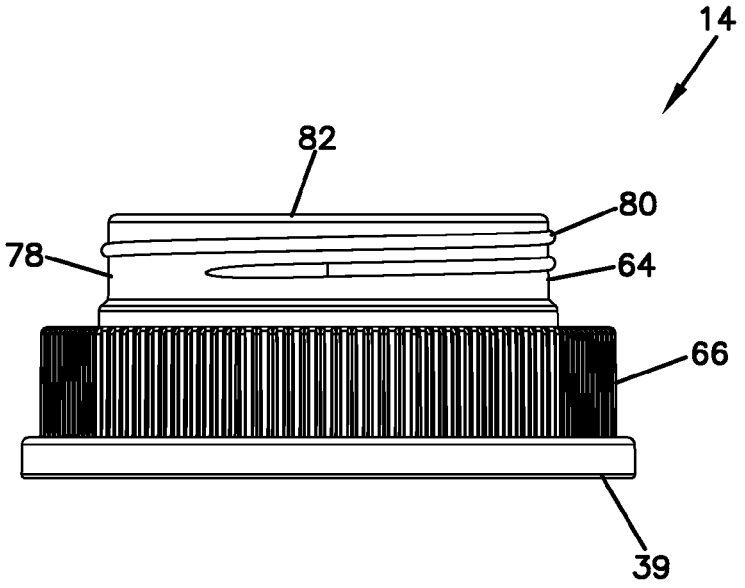
FIG. 13 is a rear side elevational view of the lid of FIG. 10.
Figure 14:
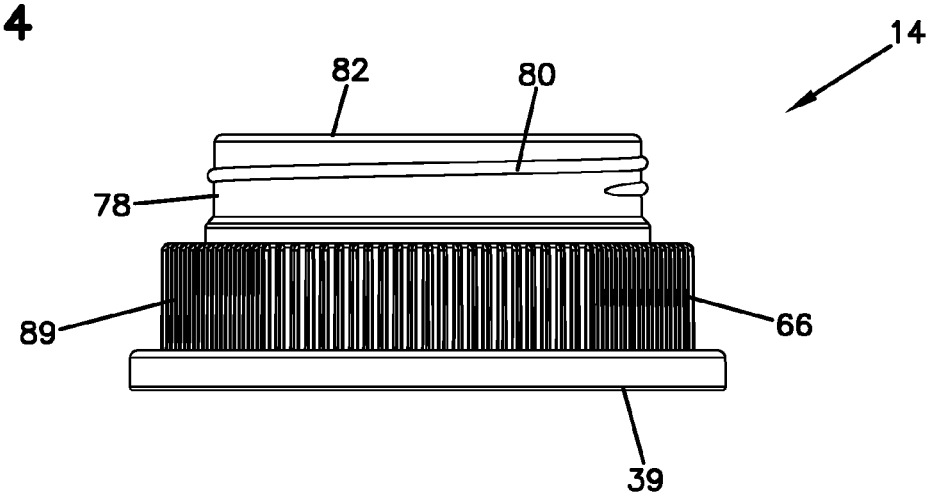
FIG. 14 is a right side elevational view of FIG. 10.
Figure 15:
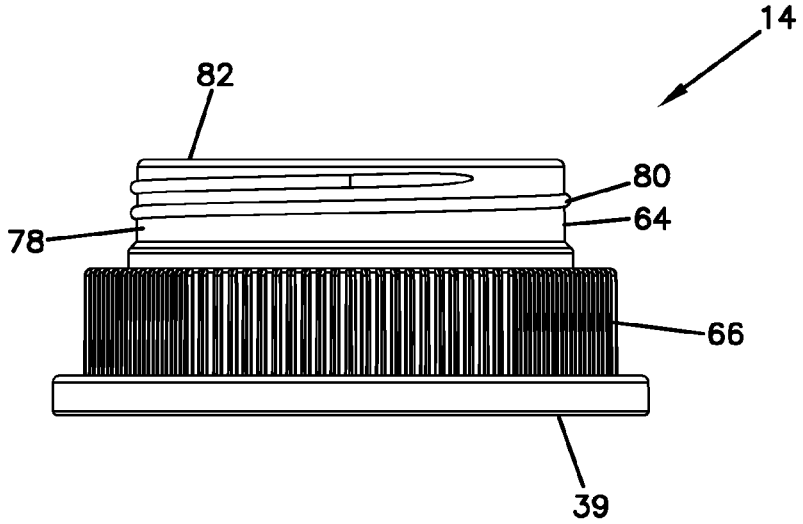
FIG. 15 is a left side elevational view of the lid of FIG. 10.
Figure 16:
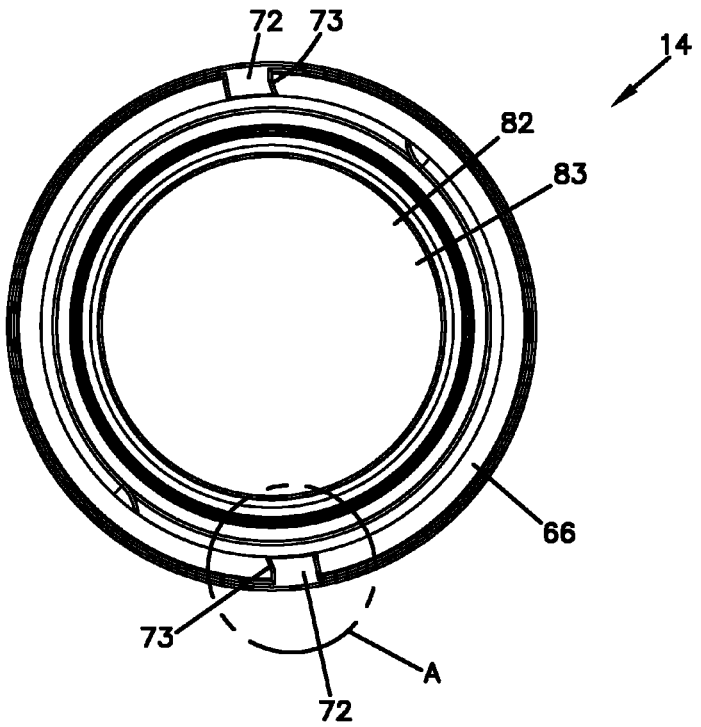
FIG. 16 is a bottom plan view of the lid of FIG. 10.

When the lid 14 is configured to mate with the container 12 in an unlocked state, the lid 14 is turned over from its orientation shown in FIG. 10, and the first skirt 64 is received within the opening 22 of the container 12. The external lid thread 80 is then engaged with the internal container thread 32. The lid 14 is then rotated relative to the container 12, to engage the thread 80 with the thread 32. This provides closure to the container 12, but the closure is unlocked. That is, when the external lid thread 80 is engaged with the internal container thread 32, it is not child resistant. This type of arrangement can be helpful for adults with arthritis or other difficulties in operating the push tab assembly 38.

In the embodiment illustrated, the lid 14 further includes a second skirt 66, which is coaxial with the first skirt 64. In this embodiment, the second skirt 66 is spaced both radially and axially relative to the first skirt 64. An end tip of the second skirt 64 is the rim 39, which engages the end of the wall 27 of the container 12 when the lid 14 is operably oriented on the container 12.

In the embodiment shown, the first skirt 64 circumscribes an end wall 82. The end wall 82 defines an outer surface 81 and an inner surface 83. Between the first skirt 64 and the second skirt 66 is an intermediate wall 84. In the embodiment shown, the intermediate wall 84 is generally parallel to the end wall 82. Extending from the intermediate wall 84 in a direction opposite from the first skirt 64 is the second skirt 66, which ends at the rim 39.

In the embodiment shown, the second skirt 66 includes an inner surface 68 with lid internal threads 70 positioned thereon. In this embodiment, there are two lid internal threads 70. Both threads 70 can engage the single external container thread 34. By having two internal threads 70 located about 180 degrees apart, less rotation of the lid 14 relative to the container 12 is required for securing the lid 14 to the container 12, then if there were only a single lid internal thread 70.

In the embodiment shown, the second skirt 66 further includes at least one locking lug 72 positioned on the internal surface 68. As mentioned above, the locking lug 72 engages the locking edge 62 to lock the lid 14 to the container 12. While only a single lug 72 is needed, in the particular embodiment shown, a pair of lugs 72 are depicted. The lugs 72 are located about 180 degrees relative to each other.

Figure 17:
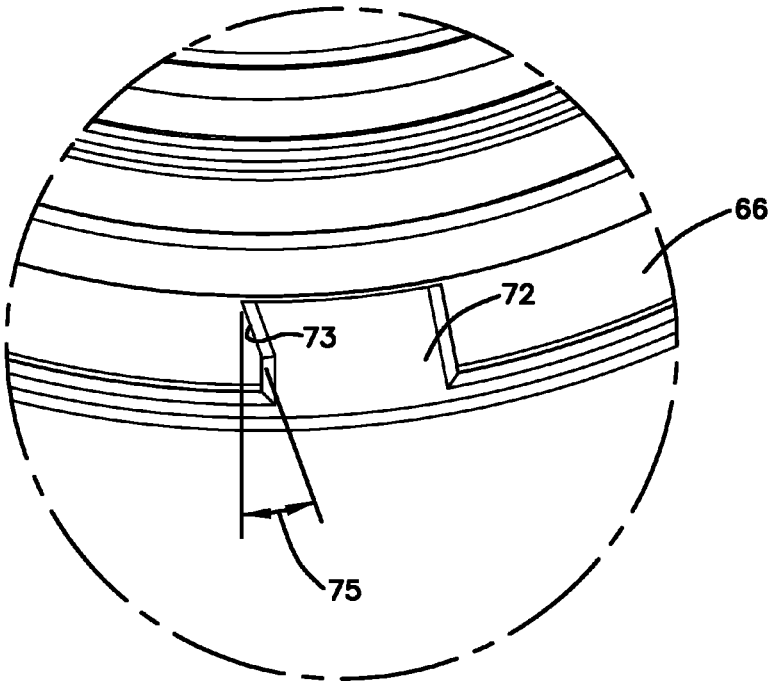
FIG. 17 is a enlarged view of the portion of FIG. 16 shown in Section A.
Figure 18:
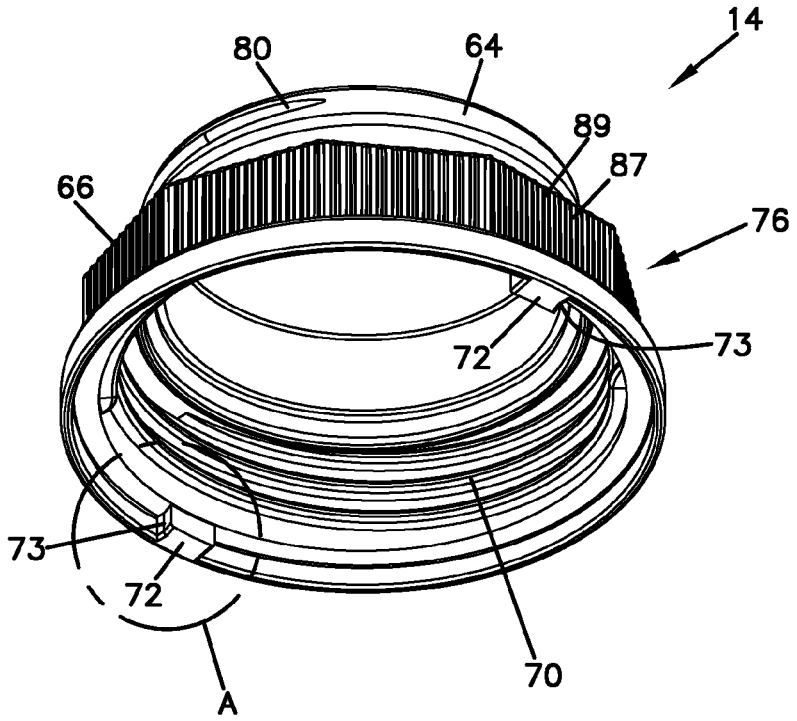
FIG. 18 is a perspective view of the lid of FIGS. 10-17.
Figure 19:
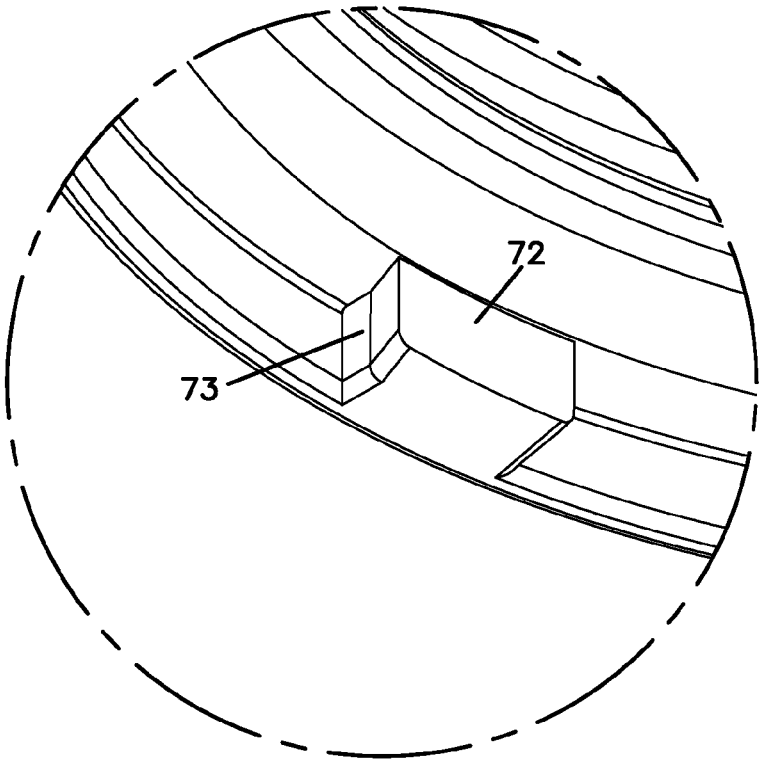
FIG. 19 is an enlarged perspective view of a portion of FIG. 18 depicted in Section A.
Figure 20:
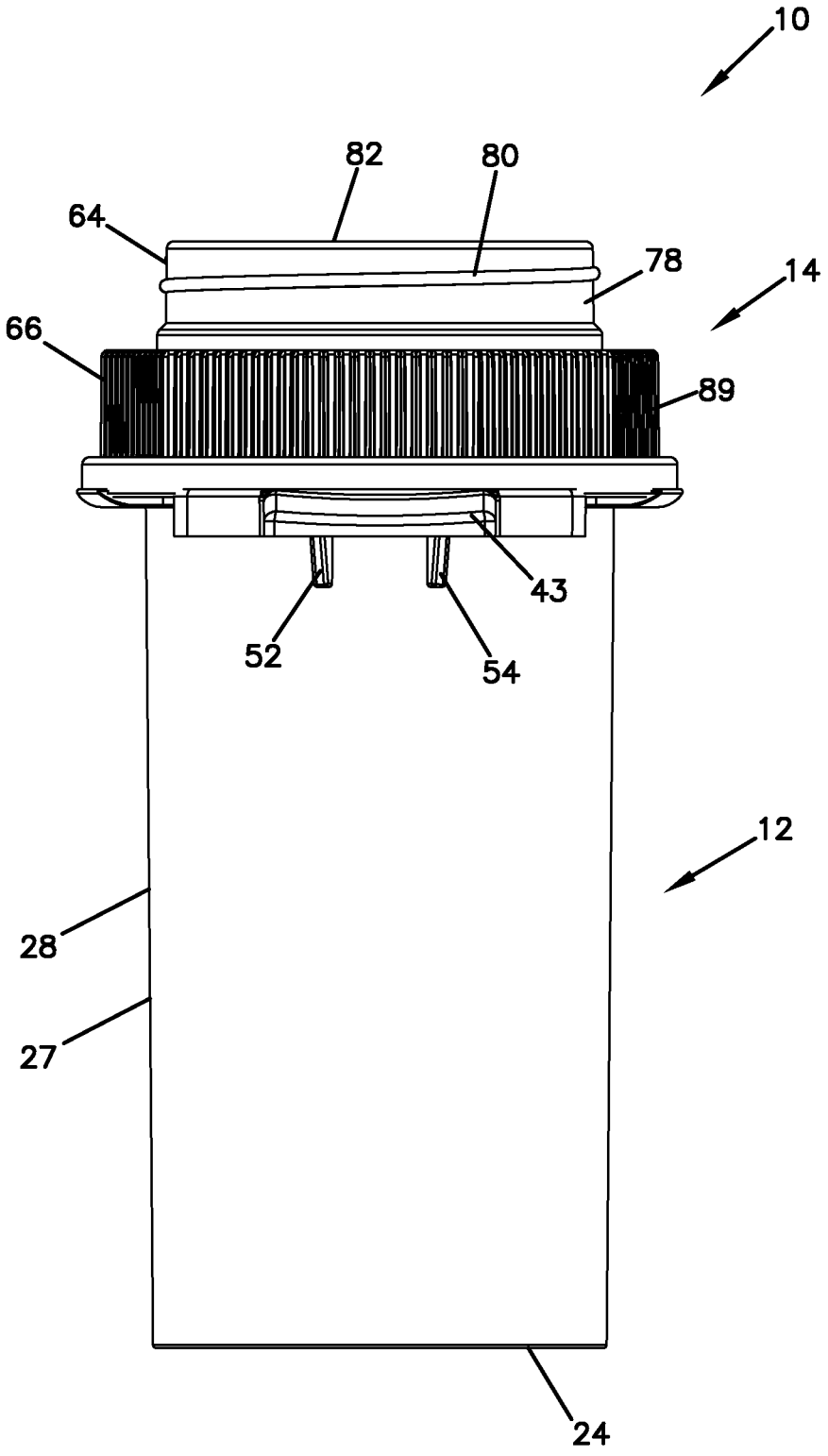
FIG. 20 is a front elevational view of the assembly of FIG. 3.
Figure 21:
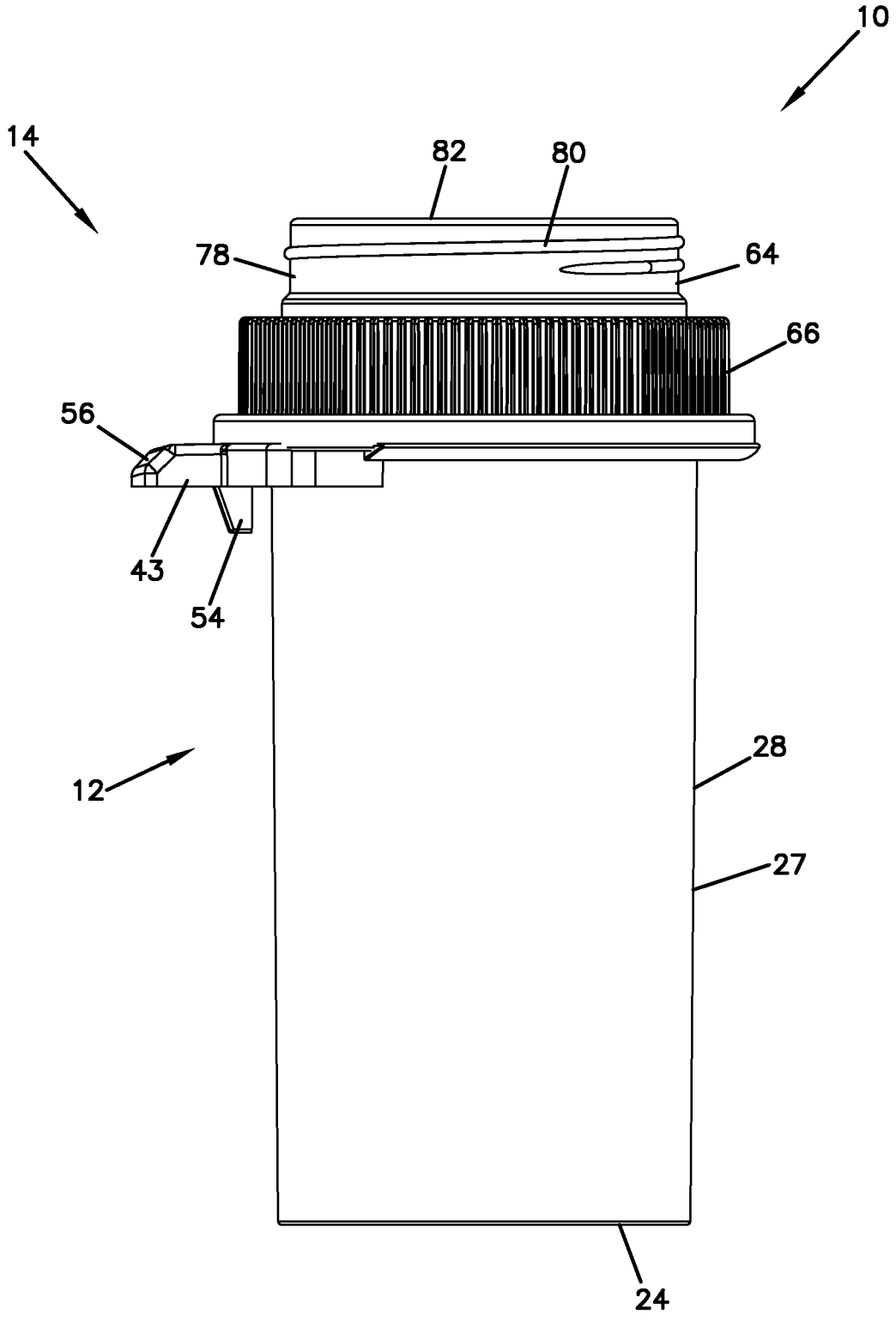
FIG. 21 is a right side elevational view of the assembly of FIG. 3.
Figure 22:
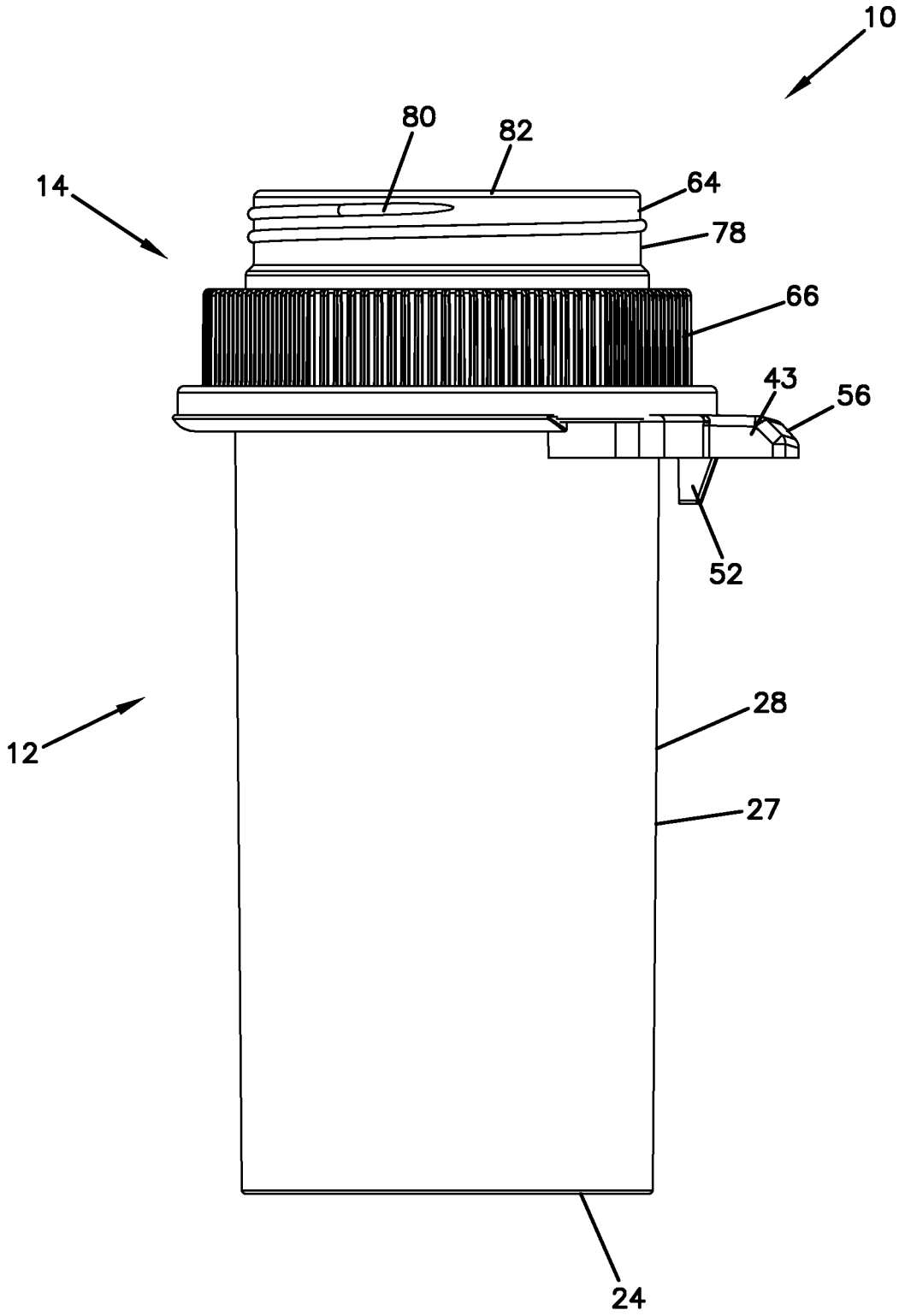
FIG. 22 is a left side elevational view of the assembly of FIG. 3.
Figure 23:
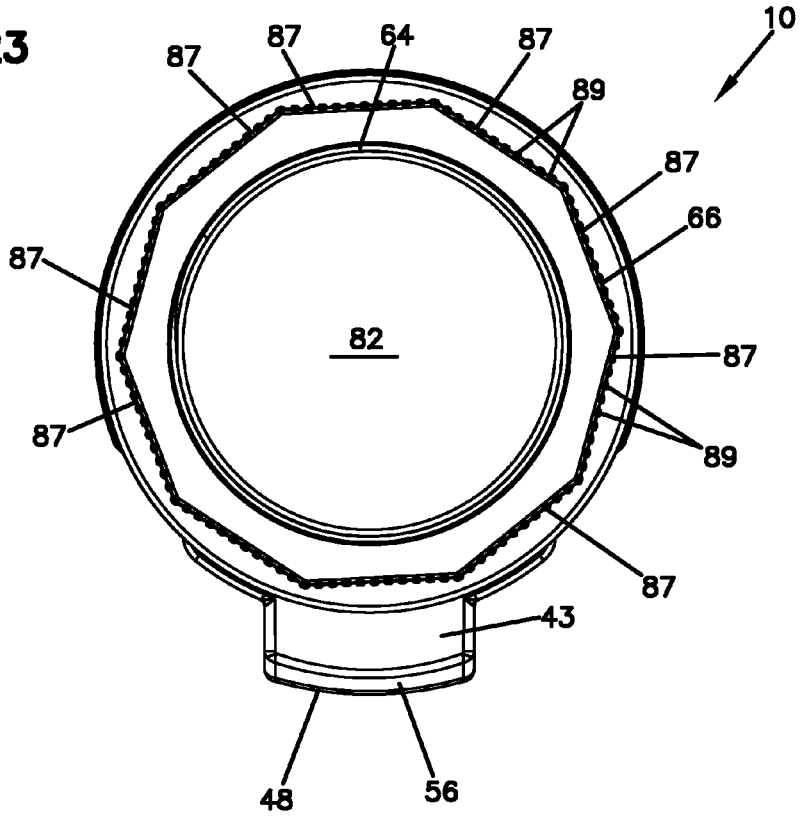
FIG. 23 is a top plan view of the assembly of FIG. 3.
Figure 24:
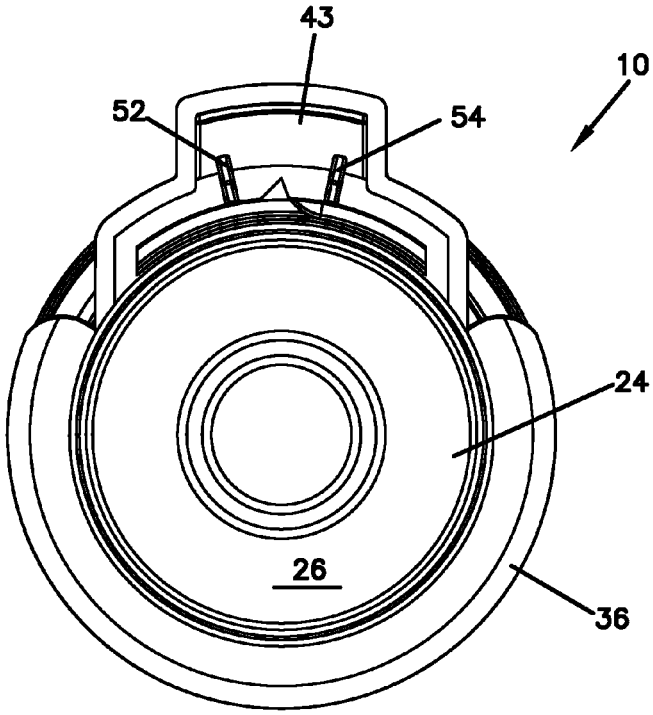
FIG. 24 is a bottom plan view of the assembly of FIG. 3.

As mentioned above, the lugs 72 includes lug edge 73 projecting radially from the second skirt 66. In this embodiment, the lug edge 73 is tapered as it extends radially inwardly. This tapering is shown in FIG. 17 at angle 75. Preferably, the lug edge 73 is tapered at an angle of 10-30 degrees, and in the embodiment shown, it is shown tapered at an angle of 15-25 degrees. The combination of both the tapered lug edge 73 and the tapered locking edge 62 helps to result in a child resistant feature that is more secure and more difficult to defeat than if the respective edges were not tapered.

The second skirt 66 further defines an external or outer surface 74. In this embodiment, the external surface 74 defines a gripping arrangement 76. The gripping arrangement 76 allows for easier gripping and manipulation of the lid 14 relative to the container 12. In this embodiment, the gripping arrangement 76 is embodied as a perimeter shaped as a regular polygon having at least six sides 87. In the particular embodiment illustrated, the regular polygon has at least ten sides 87. Having a plurality of flat sides 87 spaced regularly and evenly around the perimeter of the lid 14 allows for various surfaces for gripping and allows for easier manipulation of the lid relative to the container.

Preferably, and as shown in the embodiment of FIGS. 10-15, the sides 87 also include serrations 89. The serrations further enhance gripping capability of the lid 14.

C. Methods

In view of the above, it should be apparent that the lid 14 and container 12 can be used together as a way of providing closure to the opening 22 of the container 12. The lid 14 can be mounted to the container 12 in either a locked child resistant state or in an unlocked state.

One such method includes selectively operably locking the lid 14 onto the container or vial 12 by engaging the internal thread 70 on the lid 14 with the exactly one external thread 34 on the container 12. The lid 14 is turned relative to the container 12 to engage these threads 34, 70 and then the lug 72 is slid along the ramped surface 60 until the lug edge 73 snaps over the locking edge 72 of the locking member 50. The tapered surfaces of the lug edge 73 and the locking edge 62 engage against each other and provide for a child resistant lock.

When the user would like to access the contents of the container 12, the lid 14 is selectively released from the container 12 by unlocking the lid 14 from the container 12. This is done by exerting a push force, for example, by using the user's thumb to push on the push tab assembly 38. The user will exert the pushing force onto the bevel 56 of the engagement member 43, while also rotating the lid 14 relative to the container 12. This will release engagement between the locking edge 62 and the lug edge 73. The lid 14 is rotated relative to the container 12, until the external container thread 34 and the lid internal thread 70 are unmated.

If the user would like to secure the lid 14 to the container 12 in an unlocked condition, the user will turn the lid 14 over such that the end wall 82 can be placed within the opening 22 of the container 12. The lid external threads 80 are then mated with the container internal threads 32 in order to secure the lid 14 to the container 12, but secured in a way that it is not locked in a child resistant mode.

We claim:

1. A push tab container comprising:

(a) a container having an open end, an external surface, an internal surface; exactly one external container thread positioned on the external surface; exactly one internal container thread positioned on the internal surface; and a push tab assembly mounted on the external surface, the push tab assembly including:

(i) an engagement member having a top surface facing the open end, and a contact edge defining a free end of the engagement member;

(A) the contact edge being spaced radially outwardly from the external surface of the container;

(ii) at least one connecting arm adapted to mount the engagement member to the external surface of the container; and (iii) a locking member extending from the top surface of the engagement member in a direction toward the open end of the container; the locking member defining a ramped surface facing the open end; the ramped surface ending at a locking edge;

(A) the locking edge being vertically oriented with respect to the ramped surface; and (B) the locking edge being tapered as it extends radially inwardly.

2. The push tab container of claim 1 wherein the locking edge is tapered at an angle of 10-30 degrees.

3. The push tab container of claim 1 wherein the contact edge is beveled in a direction downwardly and outwardly about 40-50 degrees from a direction of the open end of the container.

4. A lid configured to mate with a push tab container; the lid comprising:

(a) a first skirt;

(i) the first skirt having at least one external lid thread positioned on an external surface of the first skirt;

(b) a second skirt;

(i) the second skirt having exactly two internal lid threads and at least one locking lug positioned on the internal surface of the second skirt;

(A) the locking lug including a lug edge projecting radially from the second skirt;

(B) the lug edge being tapered as it extends radially inwardly;

(ii) the second skirt having an external surface with a perimeter shaped as a regular polygon having at least 6 sides.

5. The lid of claim 4 wherein second skirt external surface has at least 10 sides, and each of the sides of the second skirt external surface is serrated.

* * * * *